US005467424A

United States Patent [19]

Davies et al.

[11] Patent Number: 5,467,424

[45] Date of Patent: Nov. 14, 1995

[54] APPARATUS AND METHOD FOR GENERATING STEAM

[75] Inventors: John T. Davies, El Sobrante; Stephen J. Egbert, Palo Alto; John R. Wagar, Bethel Island, all of Calif.

[73] Assignee: GaSonics, Inc., San Jose, Calif.

[21] Appl. No.: 273,570

[22] Filed: Jul. 11, 1994

[51] Int. Cl.[6] ..... F22B 1/28

[52] U.S. Cl. ..... 392/401; 392/394; 122/36; 122/486

[58] Field of Search ..... 392/394, 400, 392/401, 402, 403, 404, 405; 122/36, 460, 483, 486

[56] References Cited

U.S. PATENT DOCUMENTS

| | | | |
|---|---|---|---|
| 3,209,125 | 9/1965 | Morrissey | 392/402 |
| 3,951,610 | 4/1976 | Freebairn | 392/405 |
| 4,546,726 | 10/1985 | Nagasaka et al. | 118/719 |
| 5,105,556 | 4/1992 | Kurokawa et al. | 34/470 |

*Primary Examiner*—Philip H. Leung

*Attorney, Agent, or Firm*—Townsend and Townsend and Crew

[57] ABSTRACT

Apparatus and method for generating steam free of silica-containing droplets. The apparatus makes use of the fractional distillation properties of water/quartz mixtures. At the moderately high pressures and corresponding boiling temperatures which are used in the apparatus, the steam generated from water containing quartz is considerably purer than the water from which it originated. The apparatus includes a boiler supplied with de-ionized water. The boiler has a steam generating chamber and level indicators to provide sensing of overfill and underfill levels, respectively. Steam passes out of the boiler chamber into and through a large number of small vent holes into another chamber containing quartz pieces. Droplets collect on these quartz pieces and either evaporate or gravitate and return to the boiler chamber. All parts of the apparatus of the apparatus are made of quartz except the dump valve body which is constructed from plastic material. A microprocessor-based controller provides the proper sequence of water filling, boiling, automatic level control, heat power level and emptying the water at the end. This is triggered by the controller as appropriate and returns normal and emergency conditions to the main controller. It also provides for the use of safety interlocks.

35 Claims, 3 Drawing Sheets

APPARATUS AND METHOD FOR GENERATING STEAM

BACKGROUND OF THE INVENTION

The benefits of high pressure oxidation in the processing of semiconductor wafers are set out in several previous disclosures, e.g., those by Boitnott et al. in U.S. Pat. No. 5,167,717 and Tools et al., U.S. Pat. No. 5,167,716.

In the prior art, steam is usually generated by evaporating de-ionized water from a hot quartz surface in a wafer chamber. This simple method works well, but as semiconductor device geometries became smaller, it has been discovered that small particles of an amorphous silica material remain on the wafer surfaces. The particle diameters are typically in the submicron to micron range.

These particles are conjectured to be the residues after evaporation of quartz-containing water droplets entrained in the steam. Droplets are created when water boils violently. The solubility of quartz in water is fairly low and dependent on the surface structure and temperature, but it is still adequate to support the above conjecture. Potential problems that can be caused by water droplets and silicious material in steam are well known to those with experience in the steam power industry (Babcock & Wilcox, "Steam/Its Generation and Usage" 39th ed. 1975).

To avoid problems caused by silica-laden water droplets, several methods are available, some of which may be used in combination. They are as follows:

1) Boiling relatively gently so that water surface agitation and droplet formation are minimized. This may not be compatible with generating large volumetric steam flows.
2) Separating the water droplets from the steam vapor (drying). Various methods of doing this are well known in the steam power industry.
3) Boiling the water in a vessel that does not dissolve residues harmful to the process.

The choice of boiler materials is limited by the elevated temperatures at which water boils at high pressures, and the necessity of avoiding contamination of the processes. Teflon is a possible material but it does not have good, stable thermomechanical properties when subjected to thermal cycling. Metal boilers would require rigorous testing to prove contamination-free processing. The surface of silicon carbide is rapidly converted to quartz when exposed to water at high temperature.

SUMMARY OF THE INVENTION

The present invention is directed to apparatus and a method for generating steam which is relatively free of silica-containing droplets. In addition to the properties described above, the present invention makes use of the fractional distillation properties of water/quartz mixtures. At the moderately high pressures and corresponding boiling temperatures which are used in the invention, the steam generated from water containing quartz is considerably purer than the water from which it originated.

FIG. 1 herein shows the ratio of steam purity to water purity as a function of pressure. This permits the apparently paradoxical use of quartz itself as a suitable boiler material, provided that the steam is droplet-free.

Pure quartz construction is quite acceptable to the semiconductor industry. It is conventionally used in equipment of this type as an inner vessel to separate the water-containing space from the heaters which are kept in an inert gas environment. The pressure differential across the quartz wall is limited to typically 1–2 atmospheres or less to prevent breakage, the main pressure containment being borne by a thick outer vessel of metal.

The apparatus of the present invention includes a boiler which is supplied with de-ionized water at suitable pressure. The boiler has a steam generating chamber level indicators to provide sensing of overfill and underfill levels, respectively. The boiler is shaped to provide a relatively large water surface area for its volume to promote gentler water boiling. Steam passes out of the boiler chamber into and through a large number of small vent holes into another chamber containing quartz pieces. Droplets collect on these quartz pieces and either evaporate or gravitate and return to the boiler chamber. This method of droplet separation was chosen as it is effective at low steam flow velocities. Such velocities are preferred in semiconductor process equipment to avoid redistributing any particle matter which does happen to be present. The quartz pieces in the example are preferably short lengths of quartz tubing but many other shapes are possible.

All parts of the apparatus of the present invention are made of quartz with the exception of the dump valve body which is constructed from plastic material. Teflon can be used up to pressures near 20 atmospheres but it has a tendency to "cold flow" under thermomechanical stress. A microprocessor-based controller provides the proper sequence of water filling, boiling, automatic level control, heat power level and emptying the water at the end. This is triggered by the controller as appropriate and returns normal and emergency conditions to the main controller. It also provides for the use of safety interlocks.

The primary object of the present invention is to provide a steam generator and method of generating steam which is relatively free of silica-containing droplets. The apparatus makes use of fractional and distillation properties of water/quartz mixtures. The steam generated from the apparatus is considerably purer than the water from which it originated. This permits an apparently paradoxical use of quartz itself as a suitable boiler material provided that the steam is droplet-free.

Other objects of the present invention will become apparent as the following specification progresses, reference being had to the accompanying drawings for illustration of the invention.

DETAILED DESCRIPTION OF THE PREFERRED EMBODIMENT

Figure 1:
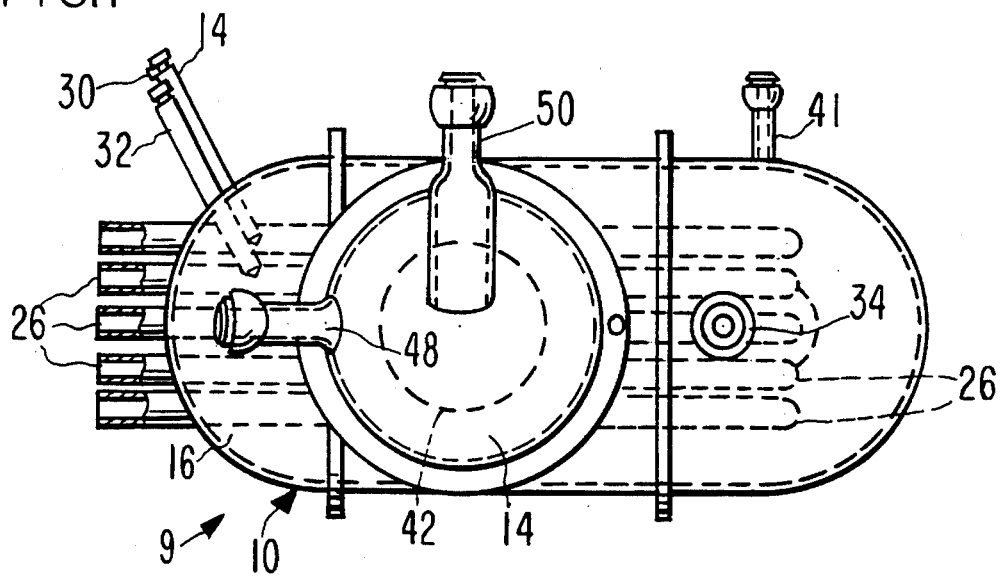
FIG. 1 is a top plan view of the boiler assembly of the present invention.
Figure 2:
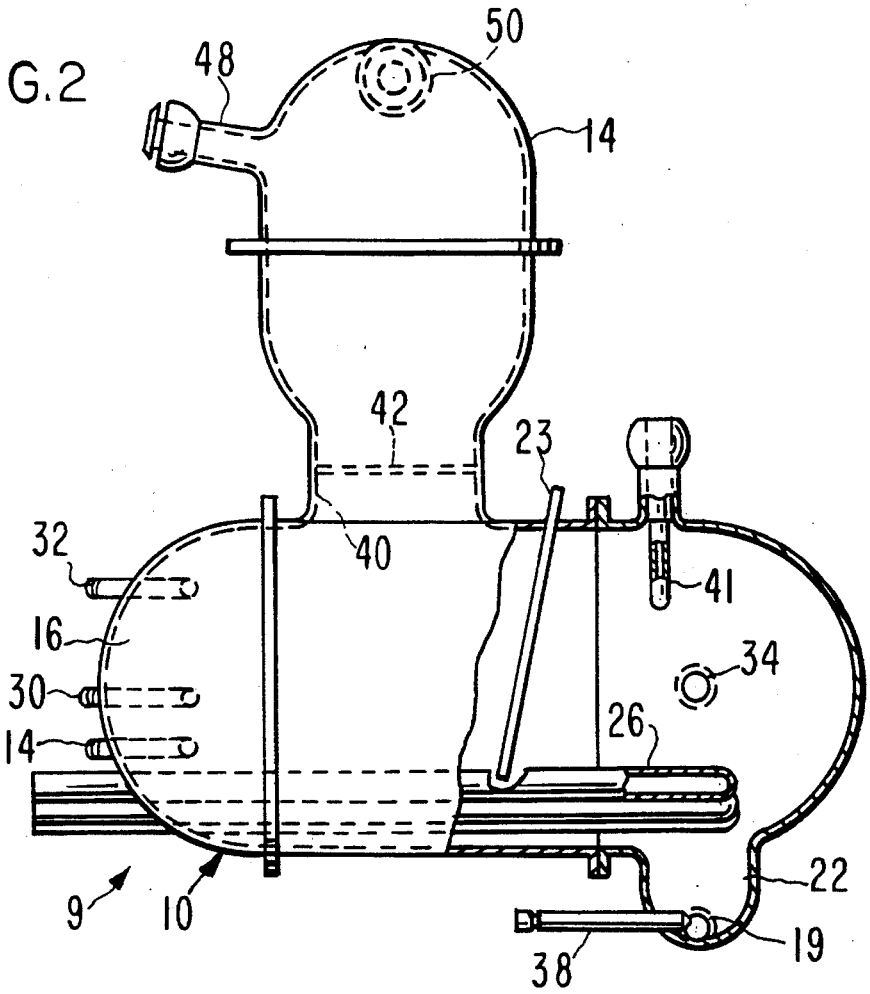
FIG. 2 is a side elevational view, partly broken away, of the boiler assembly of FIG. 1.
Figure 3:
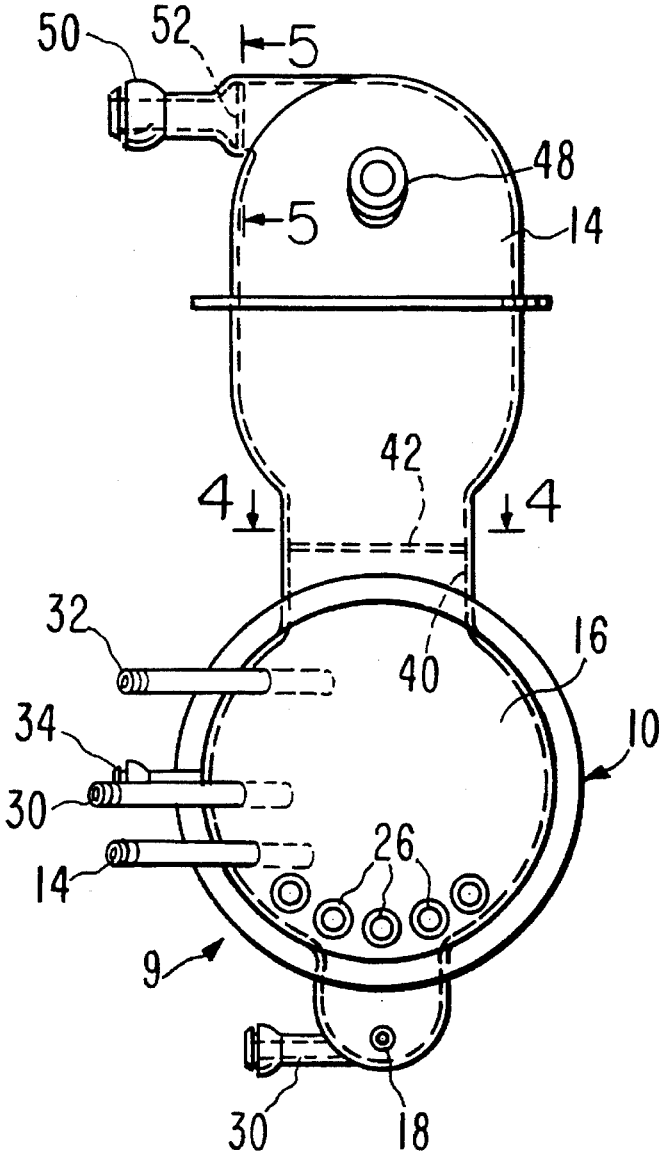
FIG. 3 is an end elevational view of the boiler assembly of FIGS. 1 and 2.

The steam generating boiler assembly of the present invention is broadly denoted by the numeral 9 and includes a boiler 10 having a chamber 12 and a steam receiving chamber 14 connected to the upper surface 16 of chamber 12. Boiler 10 is generally cylindrical and has hemispherical end members 16. Boiler chamber 12 is elongated as shown in FIGS. 1 and 2 and has hemispherical end members 16 and 18 as shown in FIGS. 1 and 2. The boiler chamber 12 is shaped to provide a relatively large water surface area for its volume to promote gentler boiling.

Boiler chamber 12 has a drain tube 19 in the bottom 20 thereof. The drain tube communicates with a hollow recess 22 which communicates with the main portion of the boiler chamber 12. An immersion heater 24 extends through the end member 16 of boiler chamber 12 and the inner end portion 26 of the heater 24 extends along the bottom of the boiler plate 12 to generate steam when immersion heater 24 is energized by electrical power.

A number of level indicators or sensors 28, 30 and 32 extend through end wall 16 and sense the level of water in the boiler chamber 12. One of the sensors, namely sensor 30, detects the normal boiling water level and is used to trigger an autofill capability in which water is directed into a port 34 through the side wall of boiler chamber 12 as shown in FIGS. 1 and 2. Sensors 28 and 32 detect underfill and overfill levels, respectively. A fourth sensor 38 (FIG. 6) monitors a boiler chamber empty condition.

Figure 6:
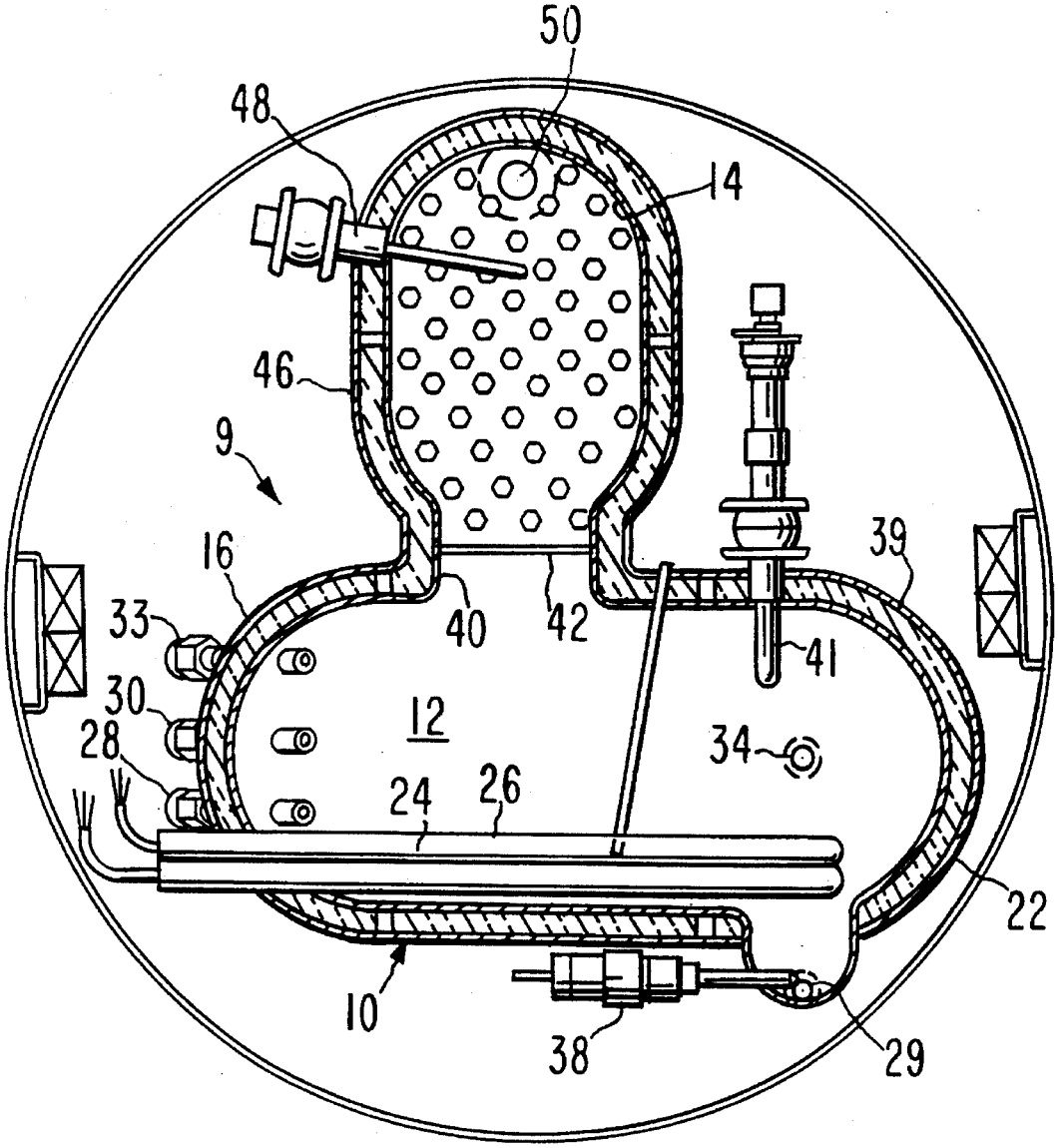
FIG. 6 is a cross-sectional view of the boiler assembly, showing the upper and lower chambers thereof with the upper chamber being filled with a plurality of quartz beads which are pieces of tubing.

A thermoswitch 41 is provided on the upper part of boiler chamber 12 to detect the over-temperature of the steam in the boiler chamber 12. There is a thermocouple well 23 in the boiler to permit water temperature measurement. A jacket 39 surrounds the boiler chamber as shown in FIG. 6 and the outer periphery of the boiler 10 is mounted in a mounting ring 37 shown in FIG. 6.

Figure 4:
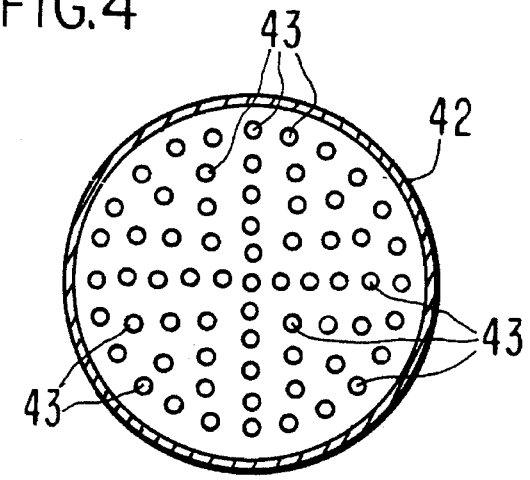
FIG. 4 is a foraminous plate taken along line 4–4 of FIG. 3, the piece separating the upper and lower chambers of the boiler assembly but placing the parts in fluid communication with each other.

The boiler chamber 12 is coupled to upper chamber 14 at an opening 40 across which a foraminous or perforate plate 42 is placed. This plate is shown in detail in FIG. 4, and is provided with a plurality of holes 43 therethrough to allow steam to pass upwardly from chamber 12 to chamber 14 and into contact with a plurality of quartz beads or pieces 46 in chamber 14. A steam thermowell and bead fill port 48 are provided near the upper end of upper chamber 14. A steam outlet 50 (FIGS. 1, 2, and 6) allows the steam to pass out of the upper part 14 and to be collected for use downstream of the boiler.

Figure 5:
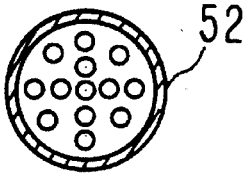
FIG. 5 is a perforate plate taken along line 5–5 of FIG. 3, showing the steam outlet of the upper chamber of the boiler.

A second foraminous member 52 (FIG. 5) is positioned across the steam outlet 50 to capture quartz drying beads.

OPERATION

A volume of de-ionized water at a suitable pressure is directed to the outlet fill tube 34 and which is below normal water level to minimize splashing. The drain tube and valve allows removal of water when the wafer growth cycle is complete. The level indicators 28, 30 and 32 detect the underfill, normal and overfill capacities of the steam boiler chamber 12.

When the immersion heater 24 is energized, it heats the water to boiling steam, and the steam passes out through holes 43 in plate 42 into the upper chamber 14 which contains a maze of quartz beads or pieces. Water droplets collect on these beads and either evaporate and pass out of the boiler 10 as steam or the droplets gravitate and return to the boiler through the foraminous plate 42. This method of droplet separation is effective at low steam velocities. Low velocities are preferred in semiconductor process equipment to avoid redistributing any particulate material which happens to be present.

The quartz pieces in the example are short lengths of quartz tubing, but other shapes can be used if desired. The "dryer" chamber has a wide bore steam exit port leading to the main process chamber through a heated tube. There is also normally a closed filling port so that the quartz pieces may be removed and replaced readily for cleaning when necessary. This is also a thermowell to enable steam temperature measurement.

All parts of the boiler of the present invention are of quartz with the exception of the dump valve body which is constructed from plastic PEEK. This material has a better thermomechanical property than Teflon. Teflon can be used up to pressures of 20 atmospheres, but its propensity to "cold flow" under thermomechanical stresses and melt or sublimate at higher temperatures makes it less desirable as a choice for the present boiler material which involves repeated cycling and stressing.

Silicon carbide appears to be a possible material for parts of this apparatus. However, tests show that its surface is rapidly converted to silicon dioxide (quartz) on exposure to water or steam. It may be a more effective material because of its higher absorption in the visible and infrared spectrum, but is more difficult to fabricate complex shapes.

The boiler unit is enclosed in a loose insulating jacket to minimize thermal losses and shield it from the direct heat of the main furnace. Thermocouples monitor the temperature of the water in the boiler, and also the dryer material. A microprocessor-based controller provides the proper sequence of water, filling boiling automatically control heater power level and emptying the water at the end. This is triggered by the main condition controller as appropriate and returns normal and emergency conditions to the main controller. It also provides some hardware and safety interlocks.

We claim:

1. A steam generator comprising:

means defining a first chamber for receiving water to be heated to steam;

means for directing water into the first chamber;

means in the first chamber for heating the water therein to a temperature sufficient to convert the water into steam;

means defining a second chamber in fluid communication with the first chamber, said second chamber adapted to receive the steam generated in the first chamber;

means in the second chamber for defining a plurality of pieces of quartz, there being a fluid outlet coupled with the second chamber for allowing steam to exit therefrom, the steam being in contact with the pieces of quartz in the second chamber as the steam moves from the first chamber to the outlet, said quartz pieces being quartz tubes or beads or quartz tubes and beads, in the second chamber.

2. A steam generator as set forth in claim 1, wherein is included means for sensing a number of levels of water in the first chamber.

3. A steam generator as set forth in claim 1, wherein the heater means includes an immersion heater.

4. A steam generator as set forth in claim 1, wherein said means defining the first chamber includes a vessel having a side wall, said means for filling the first chamber including a tube having a port and extending through the side wall, said tube adapted to be coupled to a source of de-ionized water.

5. A steam generator as set forth in claim 1, wherein said means defining said first chamber includes a vessel having a wall, said heating means including an immersion heater extending through the wall of the vessel; and a thermocouple coupled with the immersion heater for controlling the operation thereof.

6. A steam generator as set forth in claim 5, wherein the vessel has a bottom, the immersion heater being, adjacent the bottom of the vessel.

7. A steam generator as set forth in claim 1, wherein said means defining the first chamber includes a vessel having a bottom, and a wall portion on the bottom defining a recess, said recess having a drain hole for draining the vessel of water.

8. A steam generator as set forth in claim 1, wherein all of the parts in contact with the water in the first chamber are made of quartz.

9. A steam generator as set forth in claim 1, wherein is included means for sensing a number of levels of water in the first chamber.

10. A steam generator as set forth in claim 1, wherein the heater means includes an immersion heater.

11. A steam generator as set forth in claim 1, wherein said means defining the first chamber includes a vessel having a side wall, said means for filling the first chamber including a tube having a port and extending through the side wall, said tube adapted to be coupled to a source of de-ionized water.

12. A steam generator as set forth in claim 1, wherein the fluid outlet includes a tube in communication with the second chamber and extending outwardly therefrom, there being a perforate plate in the tube near an entrance end thereof for serving to at least partially dry the steam and capture quartz pieces.

13. A steam generator as set forth in claim 1, wherein the parts in contact with the water in the first chamber and the parts in contact with the steam in the second chamber are made of quartz; the boiler part has a shape sufficient to provide a relatively large surface area to promote gentler boiling of water.

14. A steam generator comprising:

means defining a first chamber for receiving water to be heated to steam;

means for directing water into the first chamber;

means in the first chamber for heating the water therein to a temperature sufficient to convert the water into steam;

means defining a second chamber in fluid communication with the first chamber, said second chamber adapted to receive the steam generated in the first chamber; and a tubular part connecting the first and second chambers, and a perforate barrier between the first and second chambers, there being a plurality of pieces of quartz in the second chamber being supported at said junction, whereby the steam passing through the perforate means at said junction will contact the quartz pieces and be dried thereby, there being a fluid outlet coupled with the second chamber for allowing steam to exit therefrom, the steam being in contact with the pieces of quartz in the second chamber as the steam moves from the first chamber to the outlet.

15. A steam generator as set forth in claim 14, wherein said barrier means includes a perforate plate.

16. A steam generator as set forth in claim 14, wherein the tube extends laterally from the second chamber.

17. A steam dryer apparatus comprising:

a boiler for heating water to steam;

a vessel on top of the boiler;

means for placing the boiler in fluid communication with the vessel whereby steam will pass from the boiler to the vessel;

means defining a fluid outlet on the vessel for steam directed thereinto; and means defining a plurality of quartz pieces in the vessel for contact by the steam whereby droplets of water can collect on the pieces and evaporate as dried steam or gravitate into the boiler, the quartz pieces including a plurality of quartz beads.

18. A steam dryer as set forth in claim 17, wherein is included a perforate plate placing the boiler in fluid communication with the vessel.

19. A steam dryer as set forth in claim 17, wherein the quartz pieces include quartz beads substantially filling the vessel.

20. A steam dryer as set forth in claim 17, wherein the quartz pieces include a mass of quartz tubes of relatively short length.

21. A steam dryer as set forth in claim 17, wherein said heating means includes an immersion heater.

22. A steam dryer as set forth in claim 21, wherein is included a microprocessor-based controller for controlling the filling, boiling, automatic level control, heat power level, and emptying of the water at the end of the cycle.

23. Apparatus for drying steam as set forth in claim 17, wherein said pieces in the vessel include silicon carbide pieces.

24. A method for steam generation comprising:

providing a first chamber for receiving water to be heated to steam;

directing the water into the first chamber;

heating the water in the first chamber to temperatures sufficient to convert the water into steam;

providing a second chamber in fluid communication with the first chamber;

directing the steam from the first chamber to the second chamber; and moving the steam into contact with pieces of quartz in the second chamber as the steam moves from the first chamber to the outlet of the second chamber, the quartz pieces being quartz beads in the second chamber.

25. A method as set forth in claim 24, wherein is included the step of sensing a number of levels of water in the first chamber.

26. A method as set forth in claim 24, wherein the water is heated with an immersion heater.

27. A method as set forth in claim 24, and including directing de-ionized water into the first chamber to a predetermined height.

28. A method as set forth in claim 24, wherein said heating step includes energizing an immersion heater extending through the wall of the first chamber.

29. A method as set forth in claim 24, wherein is included the step of controlling the heat applied to the water by sensing the temperature of the water.

30. A method as set forth in claim 24, wherein is included the step obtaining the heat energy for heating the water near the lower end of the first chamber.

31. A method as set forth in claim 24, wherein is included the step of draining the first chamber through a port on the bottom, the first chamber of the chambers in contact with the water being made of quartz.

32. A method as set forth in claim 24, wherein is included the step of placing a barrier between the first and second chambers, perforating the barrier to allow fluid communication between the chambers and supporting a plurality of pieces of quartz in the second chamber by the barrier at the junction between the first and second chambers.

33. A method as set forth in claim 24, wherein is included the step of providing a fluid outlet for the second chamber and placing a perforate barrier in the fluid outlet to partially dry the steam and capture quartz beads.

34. A method as set forth in claim 24, wherein is provided a tube extending laterally from the second chamber for defining the fluid outlet.

35. A method as set forth in claim 24, wherein said first and second chambers in contact with the steam are formed of silicon carbide.

* * * * *